US007030347B2

(12) United States Patent
Lee et al.

(10) Patent No.: US 7,030,347 B2
(45) Date of Patent: Apr. 18, 2006

(54) MICROWAVE OVEN WITH MODE STIRRER

(75) Inventors: Won Hui Lee, Seoul (KR); Eung Su Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/058,352

(22) Filed: Feb. 16, 2005

(65) Prior Publication Data

US 2005/0230385 A1 Oct. 20, 2005

(30) Foreign Application Priority Data

Feb. 19, 2004 (KR) ..... 10-2004-0011019

(51) Int. Cl.
*H05B 6/74* (2006.01)

(52) U.S. Cl. ..... 219/751; 219/746

(58) Field of Classification Search ..... 219/751, 219/749, 746–748, 695–697, 756
See application file for complete search history.

(56) References Cited

U.S. PATENT DOCUMENTS

| | | | | |
|---|---|---|---|---|
| 3,517,152 A | * | 6/1970 | Giacobbe | 219/751 |
| 3,939,320 A | * | 2/1976 | Saad | 219/751 |
| 4,327,266 A | * | 4/1982 | Austin et al. | 219/749 |

FOREIGN PATENT DOCUMENTS

| | | |
|---|---|---|
| EP | 1083772 | 3/2001 |
| EP | 1315403 | 5/2003 |
| GB | 2 018 098 | * 10/1979 |
| JP | 7-65948 | 3/1995 |
| JP | 2000-068045 | 3/2000 |
| KR | 10-1999-0027212 | 10/1999 |
| KR | 20-0175173 | 3/2000 |

OTHER PUBLICATIONS

U.S. Appl. No. 10/429,831, filed May 6, 2003.
U.S. Appl. No. 10/601,550, filed Jun. 24, 2003.
English Language Abstract of JP 2000-068045.
English Language Abstract of JP 7-065948.
English language Abstract of KOREA 20-0175173.
English language Abstract of KOREA 10-1999-0027212.

* cited by examiner

*Primary Examiner*—Philip H. Leung
(74) *Attorney, Agent, or Firm*—Greenblum & Bernstein, P.L.C.

(57) ABSTRACT

A microwave oven, which has a circular polarized wave stirrer for uniformly heating food, is disclosed. The microwave oven includes a magnetron generating electromagnetic waves, a waveguide guiding the electromagnetic waves generated from the magnetron to a cavity, and a stirrer formed to an outlet of the waveguide, receiving electromagnetic waves from the magnetron, and generating two polarized waves having different electric field directions and phases.

20 Claims, 8 Drawing Sheets

MICROWAVE OVEN WITH MODE STIRRER

This application claims the benefit of the Korean Patent Application No. 10-2004-0011019, filed on Feb. 19, 2004, which is hereby incorporated by reference as if fully set forth herein.

BACKGROUND OF THE INVENTION

1. Field of the Invention

The present invention relates to a microwave oven, and more particularly, to a microwave oven having a circular polarized wave stirrer. Although the present invention is suitable for a wide scope of applications, it is particularly suitable for uniformly heating food.

2. Discussion of the Related Art

Unlike the related art cooking device using an external heating method through heat conduction and heat radiation, the microwave oven heats and cooks food by using approximately 2450 megahertz (MHz) of microwave generated from a magnetron. Generally, food is a nonconductive substance (i.e., a neutral substance), however, the molecules forming the food consist of a molecular dipole having a positive charge and a negative charge. When an electric field is applied to the food, the positive charge of all of the molecules forming the food is aligned to face the negative charge, and the negative charge is aligned to face the positive charge. Additionally, when the electric field is changed, the aligned molecules rotate in accordance with the direction of the changed electric field. As the molecules repeat the alignment process, friction occurs among each molecule, thereby generating heat within the food. The microwave oven discharges a microwave changing the electric field direction for about 2,450 million times per second. Accordingly, the molecules within the food rotate for about 2,450 million times in one second, thereby generating a corresponding amount of friction heat.

Recently, a wide range of methods for uniformly and thoroughly heating food in the microwave oven has been proposed. For example, a turntable microwave oven heats food by rotating the food on a built-in turntable, and a stirrer fan microwave oven or a rotating antenna microwave oven changes the radiative condition of the microwave in order to enhance the heating of the food. In the stirrer fan microwave oven and the rotating fan microwave oven, a stirrer fan or a rotating fan disperses the microwave radiated from a waveguide into a cavity. Such heating methods can uniformly heat the food by rotating the food along the circumferential direction, however, the food cannot be heated uniformly and equally along the diametral direction.

SUMMARY OF THE INVENTION

Accordingly, the present invention is directed to a microwave oven that substantially obviates one or more problems due to limitations and disadvantages of the related art.

An object of the present invention is to provide a microwave oven that uniformly heats food.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a microwave oven includes a magnetron generating electromagnetic waves, a waveguide guiding the electromagnetic waves generated from the magnetron to a cavity, and a stirrer formed to an outlet of the waveguide, receiving electromagnetic waves from the magnetron, and generating two polarized waves having different electric field directions and phases.

Herein, the stirrer may be formed either in a circular shape or in a polygonal shape. The stirrer may have a pair of removed portions formed at an edge of the stirrer and facing into one another. When the stirrer is formed in a polygonal shape, the pair of removed portions may be formed at two angular points facing into one another. In addition, a depth or a size of the pair of removed portions may be determined in accordance with a frequency of the electromagnetic waves generated from the magnetron. The frequency of the electromagnetic waves generated from the magnetron may be determined in accordance with the depth or the size of the pair removed portions.

A rotation axis of the stirrer may be formed to be eccentric. Also, the electric field directions of the two polarized waves generated from the stirrer may be perpendicular to one another. And, a phase difference between the two polarized waves generated from the stirrer may be 90 degrees (90°). Furthermore, amplitudes of the two polarized waves generated from the stirrer may be identical to one another.

In another aspect of the present invention, a microwave oven includes a magnetron generating electromagnetic waves, a waveguide guiding the electromagnetic waves generated from the magnetron to a cavity, and a stirrer formed to an outlet of the waveguide, and having a pair of removed portions formed at an edge of the stirrer and facing into one another.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
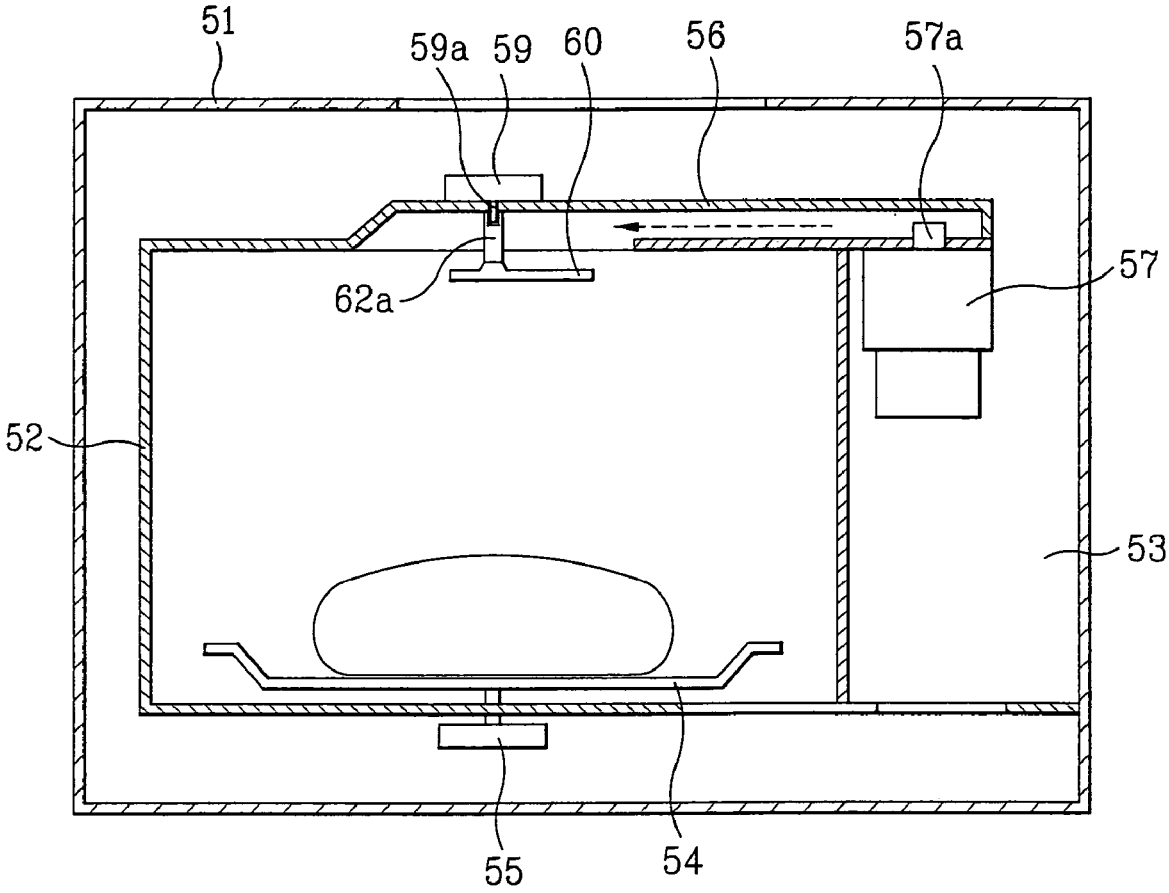
FIG. 1 illustrates the structure of a microwave oven according to the present invention.

FIG. 1 illustrates the structure of a microwave oven according to the present invention.

Referring to FIG. 1, a cavity 52 is formed inside a case 51 of a microwave oven, and a device chamber 53 is formed at a side of the case 51. A magnetron 57 generating electromagnetic waves, a plurality of devices for forming the electromagnetic waves, and other devices, such as a cooling fan and a microcomputer, are formed inside the device chamber 53. In addition, a turntable 54 is fixed at a bottom surface of the cavity 52, and the turntable 54 is connected to a rotator of a motor 55.

Furthermore, a waveguide 56 is formed to guide electromagnetic waves (i.e., microwaves) generated by the magnetron 57 to the cavity 52. As shown in FIG. 1, the waveguide 56 can be formed on the cavity 52. However, the waveguide 56 can also be formed on either one of the left and right sides of the cavity 52 or below the cavity 52. A feeder 57*a* of the magnetron 57 for supplying the electromagnetic waves into the waveguide 56 is formed within the waveguide 56. In addition, a stirrer 60 dispersing the electromagnetic waves is formed at an outlet of the waveguide 56, and a motor 59 rotating the stirrer 60 is formed on an outer surface of the cavity 52.

The stirrer 60 is formed of a round plate or a polygonal plate and also includes a pair of removed portions formed on the edge of the stirrer 60. Each of the removed portions face into one another and are symmetrical to one another along a midpoint of the plate. The rotation axis is formed at an eccentric portion of the plate, and not at the midpoint, thereby allowing the two polarized waves generated from the stirrer 60 to be symmetrical to one another.

Figure 2:
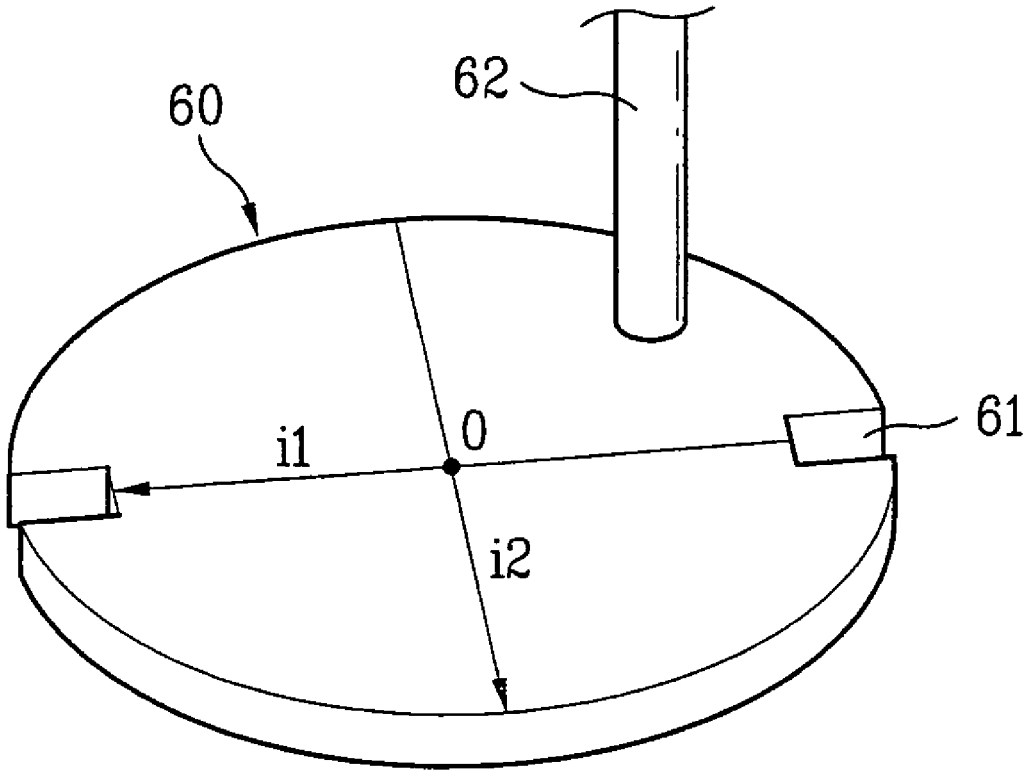
FIG. 2 illustrates a perspective view of a stirrer of a microwave oven according to a first embodiment of the present invention.
Figure 3:
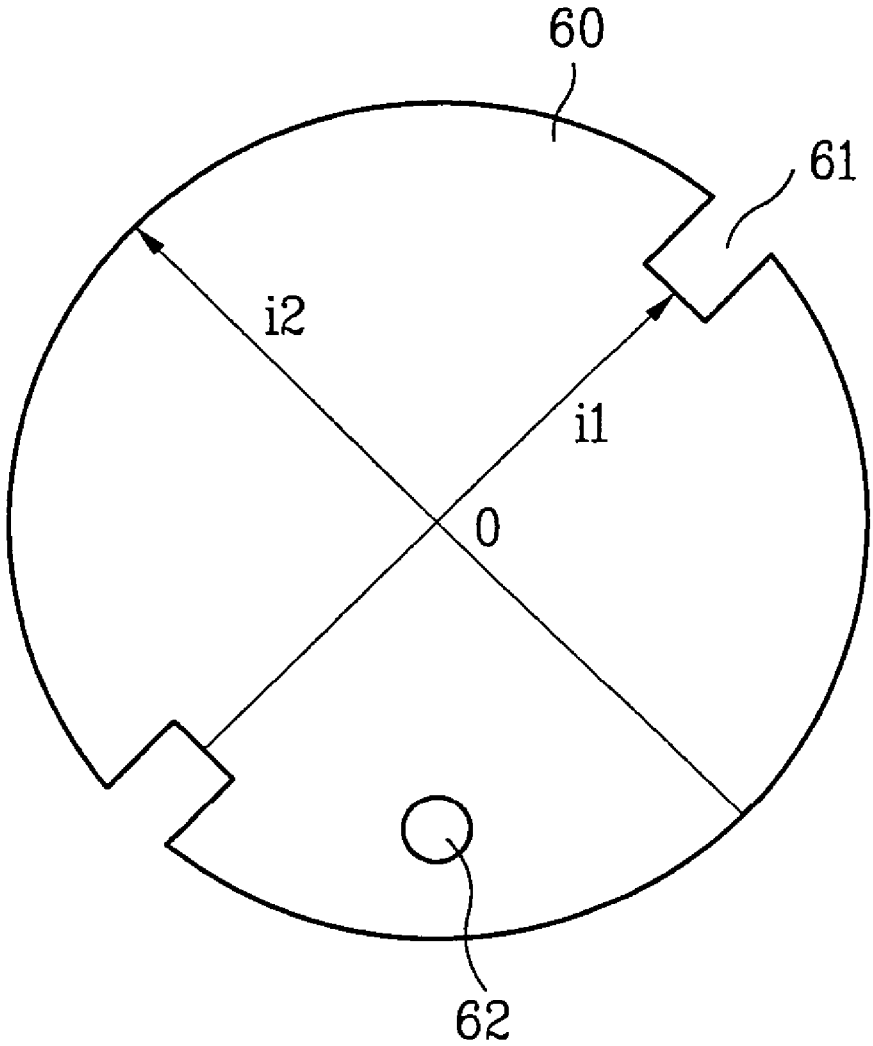
FIG. 3 illustrates a plane view of the stirrer of FIG. 2.

The stirrer 60 of the microwave oven according to a first embodiment of the present invention will now be described with reference to FIGS. 2 and 3. Referring to FIGS. 2 and 3, the stirrer 60 is formed of a circular plate. The pair of removed portions 61 is formed on the edge of the stirrer 60 to face into one another along a first imaginary line i1, which crosses a midpoint 0. Herein, the removed portions 61 are symmetrical to one another. FIG. 2 illustrates the removed portions 61 formed in a rectangular shape. Evidently, the shape of the removed portions 61 can be changed to other shapes and not be limited to the rectangular shape only.

The rotation axis 62 of the stirrer 60 is not located at the midpoint 0 but formed at an eccentric portion of the plate. When assuming that the first imaginary line i1 crossing the midpoint 0 perpendicularly crosses a secondary imaginary line i2, the rotation axis 62 is formed in any one of the areas defined by the two imaginary lines i1 and i2. The rotation axis 62 should be spaced apart from each of line i1 and line i2 at the same distance and formed in the same area, so that the two polarized waves have the exact same amplitude and the phases of the two polarized waves have an angular difference of 90°. The rotation axis 62 of the stirrer 60 acts as a feeding point for transmitting the electromagnetic waves generated from the magnetron 57. The rotation axis 62 receives the electromagnetic waves from the magnetron 57 and supplies the waves to the surface of the stirrer 60.

A resonance frequency is generated from an electric current flowing in the direction of the line i1, and another resonance frequency is generated from an electric current flowing in the direction of the line i2. A frequency generating a circular polarized wave is generated from the two frequencies, and a circular polarized wave radiation pattern is generated from the frequency. The amplitude of the two frequencies are identical, however, due to the removed portions 61, the phase of each frequency has an angular difference of 90°.

Figure 6:
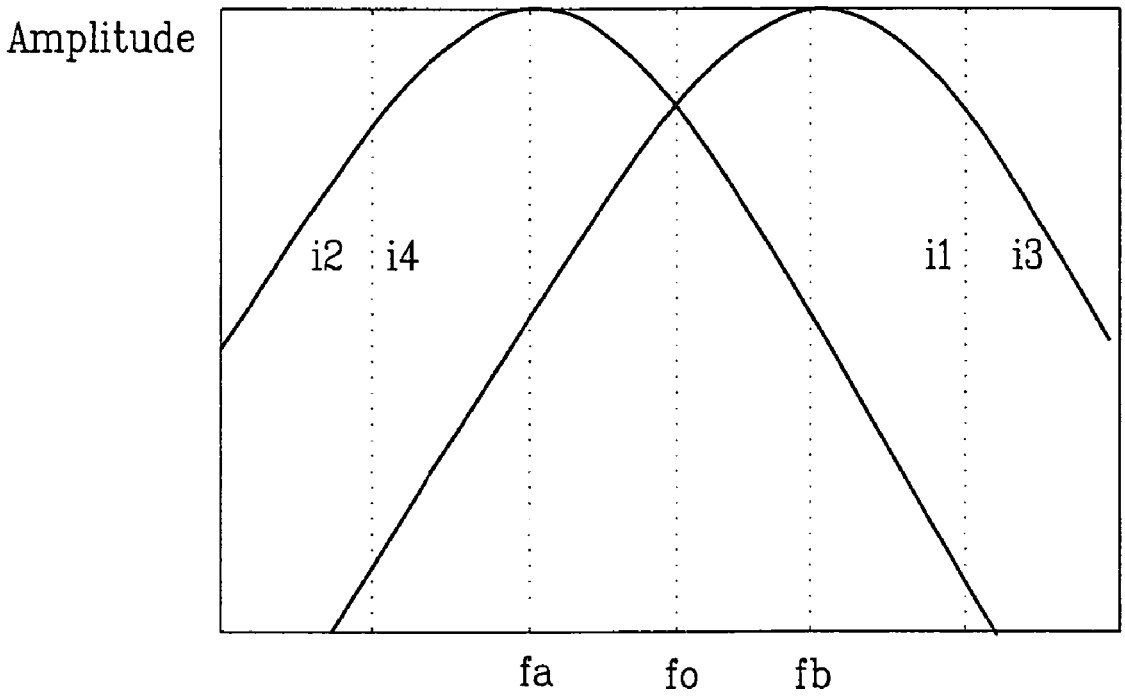
FIG. 6 illustrates a graph showing frequencies of a major axis and a minor axis of the stirrer fan.

The resonance frequency varies in accordance with the radius of the stirrer 60, more specifically, the distance between the midpoint 0 and the edge of the plate. As shown in FIG. 6, since the length of a minor axis i1 is smaller than the length of the major axis i2, the resonance frequency fb generated from the minor axis i1 is greater than the resonance frequency fa generated from the major axis i2. The depth or size of the removed portions 61 is adequately determined in accordance with the frequency fo of the electromagnetic waves provided from the magnetron 57. For example, as the frequency fo increases (or becomes higher), the depth or size of the removed portions 61 becomes larger, and as the frequency fo decreases (or becomes lower), the depth or size of the removed portions 61 becomes smaller. However, if the depth or size of the removed portions 61 is to be fixed and only the frequency fo is to be adjusted, the adjustment of the frequency fo is determined and set in accordance with the depth or size of the removed portions 61.

Figure 7:
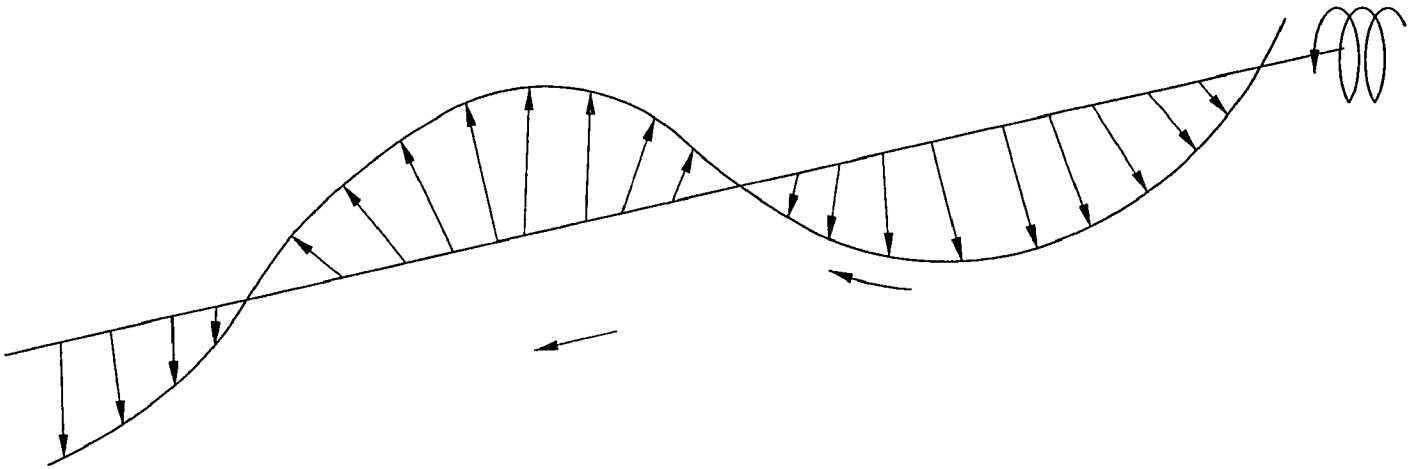
FIG. 7 illustrates a pattern of a circular polarized wave generated from the stirrer.
Figure 8:
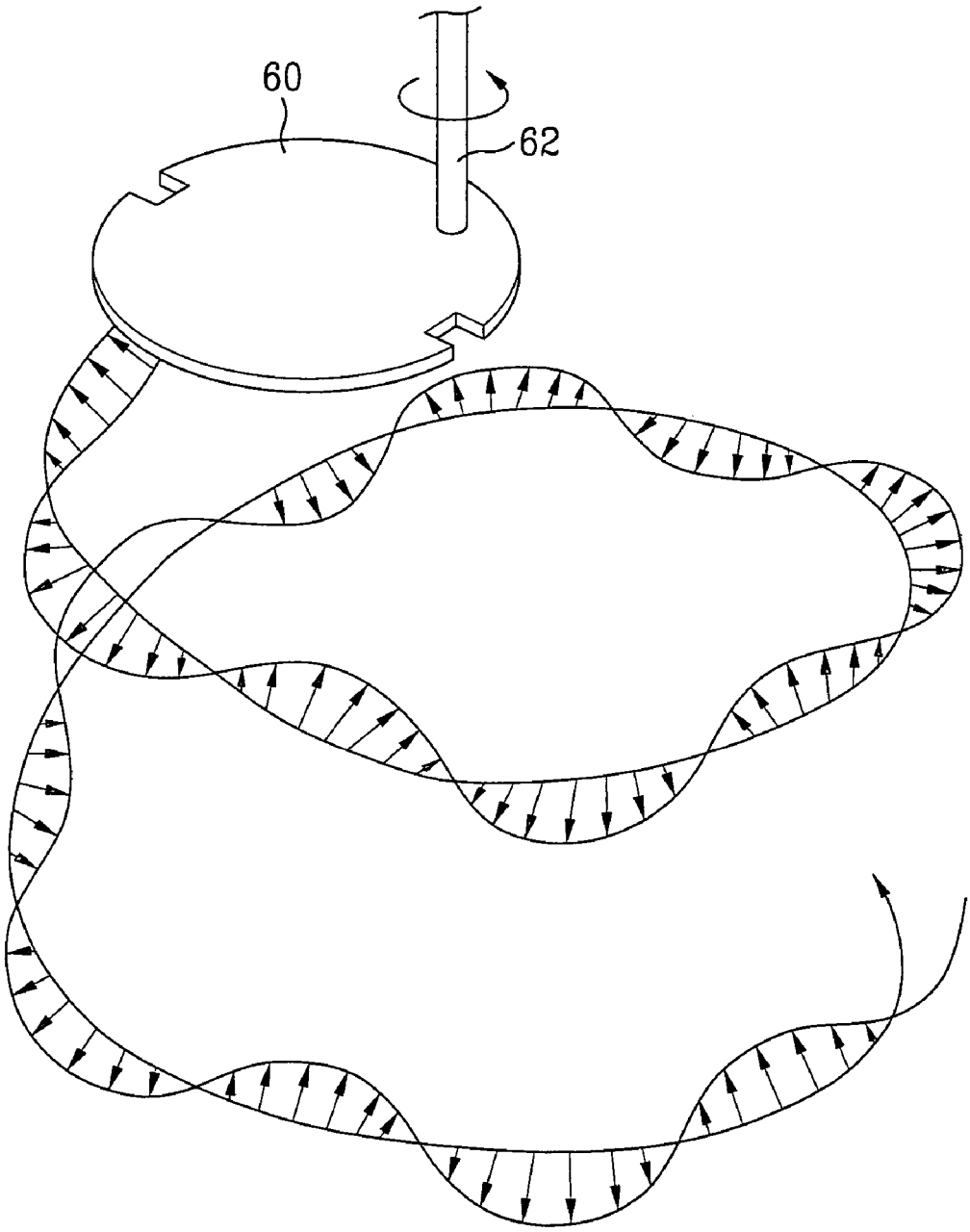
FIG. 8 illustrates a radiation pattern of a circular polarized wave generated by rotating movements of the stirrer within a cavity.

When the frequency fo of the electromagnetic waves is the exact middle of the resonance frequencies fa and fb, the stirrer 60 can generate two polarized waves being accurately symmetrical to one another. In addition, when two polarized waves have identical amplitudes and are perpendicular to one another, the two polarized waves are converted into circular polarized waves, as shown in FIGS. 7 and 8. On the other hand, when the frequency fo of the electromagnetic waves is not the exact middle of the resonance frequencies fa and fb, the stirrer 60 can generate two elliptical polarized waves.

In order to uniformly heat the food within the cavity 52, the stirrer 60 should generate various modes of polarized waves. More specifically, a plurality of polarized waves having different electric fields should be formed. The microwave oven according to the present invention not only generates two polarized waves perpendicularly crossing one another, but also a plurality of polarized waves having different forms of electric field in accordance with the number of resonance of the stirrer 60, thereby enabling food to be heated uniformly.

Figure 4:
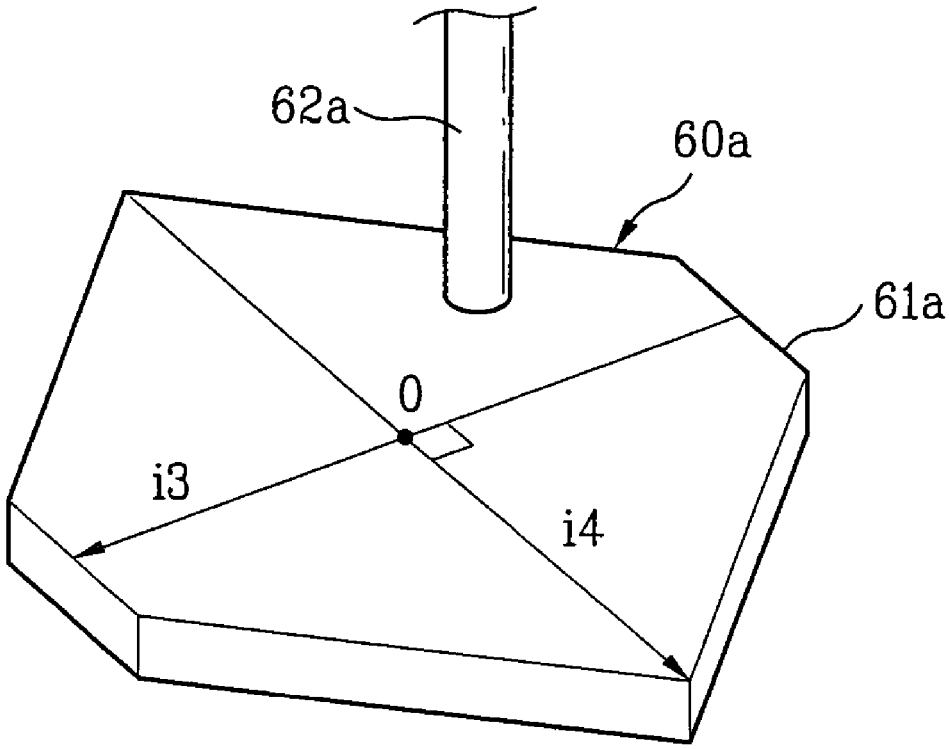
FIG. 4 illustrates a perspective view of a stirrer of a microwave oven according to a second embodiment of the present invention.
Figure 5:
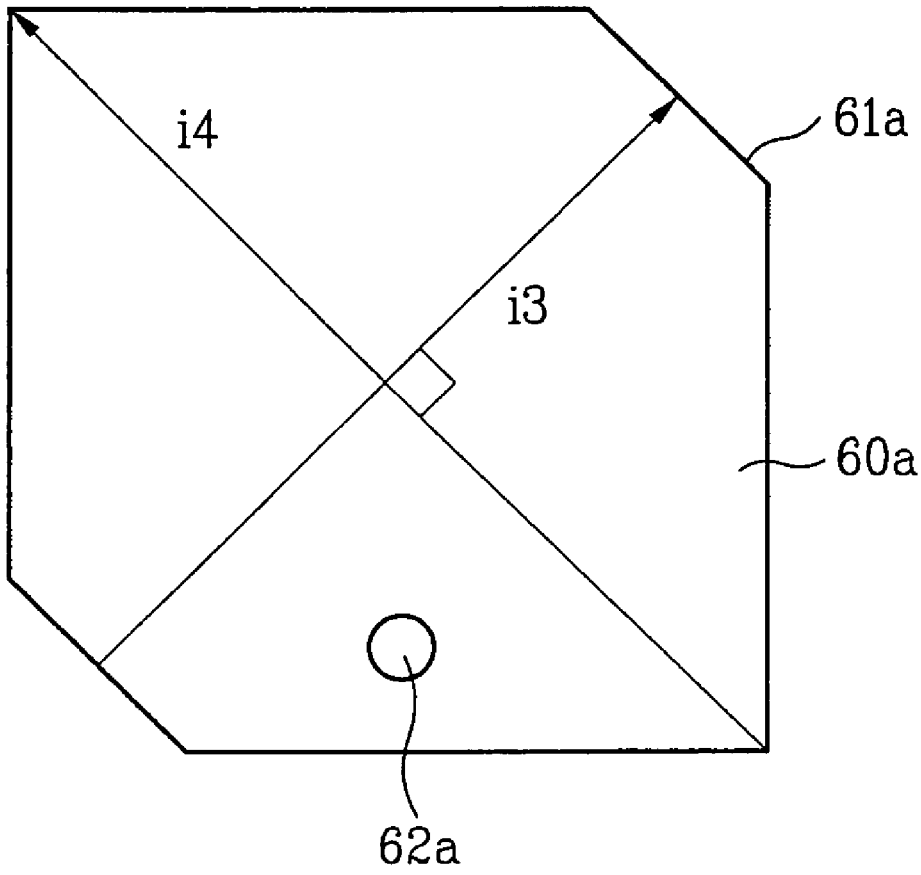
FIG. 5 illustrates a plane view of the stirrer of FIG. 4.

FIG. 4 illustrates a perspective view of a stirrer of a microwave oven according to a second embodiment of the present invention. And, FIG. 5 illustrates a plane view of the stirrer of FIG. 4. Referring to FIGS. 4 and 5, the stirrer 60*a* according to the second embodiment of the present invention is formed of a square-shaped plate. Herein, the plate of the stirrer can also be formed in many other shapes apart from a square. When the stirrer 60*a* is a square, a pair of removed portions 61*a* is formed to face into one another along an imaginary diagonal line i3, which passes through a midpoint 0. When the plate of the stirrer 60*a* is formed in the shape of a regular polygon, the pair of removed portions 61*a* is formed at each angular point facing into one another.

Herein, the removed portions 61*a* are formed in a triangular shape and are symmetrical to one another.

The rotation axis 62*a* of the stirrer 60*a* is not located at the midpoint 0, but formed at an eccentric portion of the plate. When assuming that the first imaginary diagonal line i3 crossing the midpoint 0 perpendicularly crosses a second imaginary diagonal line i4, the rotation axis 62*a* is formed in any one of the areas defined by the two imaginary diagonal lines i3 and i4. The rotation axis 62*a* should be spaced apart from each of the diagonal line i3 and i4 at the same distance and formed in the same area, so that the two polarized waves have the exact same amplitude and the phases of the two polarized waves have an angular difference of 90°. More specifically, the rotation axis 62*a* is formed on an imaginary straight line having an angular difference of 45° with the first imaginary diagonal line i3.

When the rotation axis 62*a* receives electromagnetic waves from the magnetron 57 and provides the electromagnetic waves to the surface of the stirrer 60*a*, and when the stirrer 60*a* simultaneously rotates, a resonance frequency is formed in accordance with a current flow on the surface of the stirrer 60*a* formed by the electromagnetic waves. An electric current formed at each end of the first imaginary diagonal line i3 and an electric current formed at each end of the second imaginary line i4 each generates a different frequency. Herein, the two frequencies have the same amplitude. However, due to the removed portions 61*a*, the phases of the frequencies have an angular difference of 90°.

The resonance frequency varies in accordance with the distance between the midpoint 0 and the edge of the stirrer plate. Therefore, the size of the removed portions 61*a* should be adequately determined, so that the resonance frequency fo of the electromagnetic waves generated from the magnetron 57 becomes the middle of the resonance frequency fa generated from the magnetic field of the major axis i4 and the resonance frequency fb generated from the magnetic field of the minor axis i3. When the frequency fo of the electromagnetic waves is the exact middle of the resonance frequencies fa and fb, the stirrer 60*a* can generate two circular polarized waves.

In the microwave oven according to the present invention, by forming a pair of removed portions 61 symmetrical to one another on a single structured stirrer, two different modes superposed on one another are split into two different frequencies. And, a frequency is formed at the middle of the two frequencies, the frequency has the same amplitude as the two frequencies and a phase having an angular difference of 90°. Herein, a circular polarized wave is generated from the frequency.

The stirrer of the microwave oven according to the present invention has the following advantages. The circular polarized wave stirrer generates various modes of polarized wave, thereby enabling the microwave oven to uniformly heat food. In addition, the microwave oven according to the present invention does not require a complicated structure of the stirrer in order to generate circular polarized waves. More specifically, the stirrer is easily fabricated by a simple process of removing portions of the edge of a stirrer plate.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A microwave oven, comprising:

a magnetron that generates electromagnetic waves;

a waveguide that guides the electromagnetic waves generated from the magnetron to a cavity;

a stirrer formed to an outlet of the waveguide, that receives electromagnetic waves from the magnetron, and that generates two polarized waves having different electric field directions and phases, wherein the two polarized waves are converted into circular polarized waves; and a motor connected to a rotation axis of the stirrer, the motor configured to rotate the stirrer.

2. The microwave oven of claim 1, wherein the stirrer is formed in a circular shape.

3. The microwave oven of claim 1, wherein the stirrer is formed in a polygonal shape.

4. The microwave oven of claim 1, wherein the stirrer has a pair of removed portions formed at an edge of the stirrer and facing into one another.

5. The microwave oven of claim 4, wherein, when the stirrer is formed in the polygonal shape, the pair of removed portions is formed at two angular points facing into one another.

6. The microwave oven of claim 4, wherein a depth or a size of the pair of removed portions is determined in accordance with a frequency of the electromagnetic waves generated from the magnetron.

7. The microwave oven of claim 4, wherein the frequency of the electromagnetic waves generated from the magnetron is determined in accordance with the depth or the size of the pair removed portions.

8. The microwave oven of claim 1, wherein a rotation axis of the stirrer is formed to be eccentric.

9. The microwave oven of claim 1, wherein the electric field directions of the two polarized waves generated from the stirrer are perpendicular to one another.

10. The microwave oven of claim 1, wherein a phase difference between the two polarized waves generated from the stirrer is 90 degrees (90°).

11. The microwave oven of claim 1, wherein amplitudes of the two polarized waves generated from the stirrer is identical to one another.

12. A microwave oven, comprising:

a magnetron generating electromagnetic waves;

a waveguide that guides the electromagnetic waves generated from the magnetron to a cavity;

a stirrer formed to an outlet of the waveguide, that receives electromagnetic waves from the magnetron and having a pair of removed portions formed at an edge of the stirrer and facing into one another in order to generate two polarized waves having different electric field directions and phases; and a motor connected to an eccentric rotation axis of the stirrer, the motor configured to rotate the stirrer, wherein the two polarized waves are converted into circular polarized waves.

13. The microwave oven of claim 12, wherein the stirrer is formed in a circular shape.

14. The microwave oven of claim 12, wherein the stirrer is formed in a polygonal shape.

15. The microwave oven of claim 12, wherein a depth or a size of the pair of removed portions is determined in accordance with a frequency of the electromagnetic waves generated from the magnetron.

16. The microwave oven of claim 12, wherein the frequency of the electromagnetic waves generated from the magnetron is determined in accordance with the depth or the size of the pair removed portions.

17. The microwave oven of claim 12, wherein an eccentric rotation axis of the stirrer is formed on an imaginary straight line, the imaginary straight line having an angular difference of 45 degrees (45°) with a line connecting the pair of removed portions.

18. The microwave oven of claim 12, wherein the electric field directions of two polarized waves generated from the stirrer are perpendicular to one another.

19. The microwave oven of claim 12, wherein a phase difference between the two polarized waves generated from the stirrer is 90 degrees (90°).

20. The microwave oven of claim 12, wherein amplitudes of the two polarized waves generated from the stirrer are identical to one another.

* * * * *